US012023569B2

(12) United States Patent
Grønfeldt

(10) Patent No.: US 12,023,569 B2
(45) Date of Patent: Jul. 2, 2024

(54) PLAYGROUND APPARATUS

(71) Applicant: Kompan A/S, Odense SØ (DK)

(72) Inventor: Peter Christian Løvfold Grønfeldt, Odense C (DK)

(73) Assignee: Kompan A/S

( * ) Notice: Subject to any disclaimer, the term of this patent is extended or adjusted under 35 U.S.C. 154(b) by 137 days.

(21) Appl. No.: 17/754,956

(22) PCT Filed: Oct. 19, 2020

(86) PCT No.: PCT/EP2020/079340
§ 371 (c)(1),
(2) Date: Apr. 18, 2022

(87) PCT Pub. No.: WO2021/078678
PCT Pub. Date: Apr. 29, 2021

(65) Prior Publication Data

US 2022/0379152 A1 Dec. 1, 2022

(30) Foreign Application Priority Data

Oct. 22, 2019 (DK) ..... PA201970658

(51) Int. Cl.
*A63B 9/00* (2006.01)
*A63B 5/06* (2006.01)

(52) U.S. Cl.
CPC ..... *A63B 9/00* (2013.01); *A63B 5/06* (2013.01); *A63B 2009/006* (2013.01); *A63B 2208/12* (2013.01)

(58) Field of Classification Search
CPC . A63B 2208/12; A63B 5/06; A63B 2244/085; A63B 2244/225;
(Continued)

(56) References Cited

U.S. PATENT DOCUMENTS 1,907,451 A 5/1933 Sibley
2,480,691 A 8/1949 Anderson
(Continued)

FOREIGN PATENT DOCUMENTS

DE 8911820 U 11/1989

OTHER PUBLICATIONS

Denmark Search Report issued in Denmark Application PA201970658 on Mar. 9, 2020 (4 pages).
(Continued)

*Primary Examiner* — Loan B Jimenez
*Assistant Examiner* — Kathleen M Fisk
(74) *Attorney, Agent, or Firm* — Bookoff McAndrews, PLLC

(57) ABSTRACT

A playground apparatus has a first platform assembly, a second platform assembly, and a pole structure. The first platform assembly includes a first platform structure disposed at a distance from the surface. The second platform assembly is disposed spaced apart from the first platform assembly. The second platform assembly includes a second platform structure disposed at a distance from the surface. Further, the pole structure is disposed between the first platform assembly and the second platform assembly, and includes a lever portion having at least one support structure for supporting one or more child.

9 Claims, 7 Drawing Sheets

(58) Field of Classification Search
CPC ..... A63G 1/24–26; A63G 1/38; A63G 1/40; A63G 1/42; A63G 13/00–08
See application file for complete search history.

(56) References Cited

U.S. PATENT DOCUMENTS

| | | | | | |
|---|---|---|---|---|---|
| 2,695,783 | A | | 11/1954 | Serafin | |
| 2,949,298 | A | | 8/1960 | Speelman | |
| 3,246,893 | A | * | 4/1966 | Dale | A63B 9/00 482/33 |
| 3,268,223 | A | | 8/1966 | Woodsum | |
| 3,572,698 | A | | 3/1971 | Greenly | |
| 3,587,319 | A | * | 6/1971 | Andrews | A63B 21/0083 482/3 |
| 3,730,520 | A | * | 5/1973 | Willis | A63B 9/00 472/2 |
| 3,923,302 | A | | 12/1975 | Boggild | |
| 4,494,662 | A | * | 1/1985 | Clymer | A63B 22/14 482/130 |
| 5,087,037 | A | * | 2/1992 | Morrow | A63B 25/08 482/77 |
| 6,095,950 | A | | 8/2000 | Katz | |
| 9,220,938 | B2 | | 12/2015 | Mellott | |
| 10,398,921 | B1 | * | 9/2019 | Walsh | A63B 59/70 |
| 2006/0128481 | A1 | | 6/2006 | Ballin | |
| 2008/0171637 | A1 | * | 7/2008 | Richards | A63B 5/06 482/18 |
| 2009/0197740 | A1 | | 8/2009 | Julskaer et al. | |
| 2016/0096058 | A1 | * | 4/2016 | Lin | A63B 21/4045 482/142 |

OTHER PUBLICATIONS

International Search Report and Written Opinion issued in International Application PCT/EP2020/079340 mailed on Jan. 12, 2021 (9 pages).

EPO Communication issued in corresponding European Application No. 20792984.5, mailed Mar. 5, 2024.

* cited by examiner

PLAYGROUND APPARATUS

CROSS-REFERENCE TO RELATED APPLICATION(S)

This application is a U.S. National Stage entry under 35 U.S.C. § 371 of International Patent Application No. PCT/EP2020/079340, filed on Oct. 19, 2020, which claims priority to Denmark Patent Application No. PA 201970658, filed on Oct. 22, 2019, the entirety of which is incorporated herein by reference.

TECHNICAL FIELD OF THE INVENTION

The present disclosure generally relates to a playground apparatus. More specifically, the disclosure relates to a playground apparatus which simulates a pole-vaulting activity for children to play.

BACKGROUND OF THE INVENTION

Playgrounds around the world have many different types of play apparatuses on which children can play. When children get older, they get more adventurous and play apparatuses, which have a significant height above the ground, become more and more interesting.

One type of apparatus, which could seem related to the invention of the current specification in hindsight is a crows nest type of play apparatus. This type of apparatus seems to have been popular many years ago in the patent literature. In a crows nest apparatus, a child would climb a flexible post into a crows nest or other basket like arrangement at the top of the flexible post. The child could then rock the flexible post back and forth, causing the crows nest to move back and forth in a swaying motion. Some such crows nests had room for more than one child. Some examples of these types of play apparatuses are disclosed in U.S. Pat. Nos. 2,480,691, 3,246,893, 2,949,298 and 3,268,223.

These types of crows nest apparatus are quite complicated and require a flexible post which can have a reduced lifetime and/or a risk of breakage. Furthermore, such crows nests need to be placed far from other apparatus so that the crows nest does not come into contact with other play apparatus. As such, the crows nest apparatus is an apparatus which is a standalone activity and is not a part of a greater activity.

SUMMARY OF THE INVENTION

A first aspect of the current invention is therefore to provide a playground apparatus which is a fun apparatus for children to play on.

A second aspect of the current invention is to provide a playground apparatus which has a simple assembly with a robust construction.

A third aspect of the current invention is to provide a playground apparatus which can be integrated into a larger playground concept.

These aspects are provided at least in part by a playground apparatus according to claim 1. In this way, a playground apparatus is provided whereby a child can move him or herself from a first platform assembly to a second platform assembly as part of their travel around a playground. The motion occurs at a significant height above the ground giving a great feeling of flying. As the motion is controlled between the two platforms, the safety of the apparatus is also high.

In one embodiment, the first platform assembly includes a first climbing structure to facilitate a climbing between the surface and the first platform structure, and/or the second platform assembly includes a second climbing structure to facilitate a climbing between the surface and the second platform structure.

In one embodiment, each of the first platform structure and the second platform structure is disposed at an inclination relative to the surface. In one embodiment, the first platform structure and the second platform structure form an angle of greater than 10, greater than 15 or greater than 20 degrees to the surface. In one embodiment, the first platform structure and the second platform structure form an angle of less than 60, less than 50 or less than 40 degrees to the surface.

In one embodiment, the first and second platform structures are arranged so that the two platforms face each other and such that the angle A between the normal vectors to the surfaces of the first and second platforms is less than 100 degrees, less than 90 degrees or less than 80 degrees. In one embodiment, the angle A is greater than 10 degrees, greater than 20 degrees or greater than 30 degrees. In one embodiment, the normal vectors to the surfaces of the first and second platforms each have a component in the upwards direction.

According to one embodiment, the playground apparatus includes a spring assembly for biasing the lever portion to a central position. In one embodiment, in the central position, the lever structure is disposed substantially perpendicularly to the surface.

Further, in one embodiment, the spring assembly includes a first spring coupled between the lever portion and one of the first platform assembly or the surface, and/or a second spring coupled between the lever portion and one of the second platform assembly or the surface.

In one embodiment, the spring assembly includes a first spring coupled to the lever portion and/or a second spring coupled to the lever portion. The first spring is a torsional spring and/or the second spring is a torsional spring.

In one embodiment, the playground apparatus includes a spring assembly for biasing the lever portion towards the second position.

In one embodiment, the damping assembly and/or the spring assembly comprises a torsional damping element and/or a torsional spring element. In one embodiment, a ROSTA type element is used to combine both damping and spring properties.

According to one embodiment, the playground apparatus further includes a damping assembly for damping a movement of the lever portion.

Further, in one embodiment, the pole structure includes a base portion attached to the surface and supporting the lever portion. The lever portion is adapted to pivot relative to the base portion.

According to one embodiment, the base portion and/or the lever portion includes an upright structure and at least one safety structure extending downwardly at an inclination relative to the upright structure.

BRIEF DESCRIPTION OF THE DRAWINGS

In the following, the invention will be described in greater detail with reference to embodiments shown by the enclosed figures. It should be emphasized that the embodiments shown are used for example purposes only and should not be used to limit the scope of the invention.

DETAILED DESCRIPTION OF THE EMBODIMENTS

Figure 1:
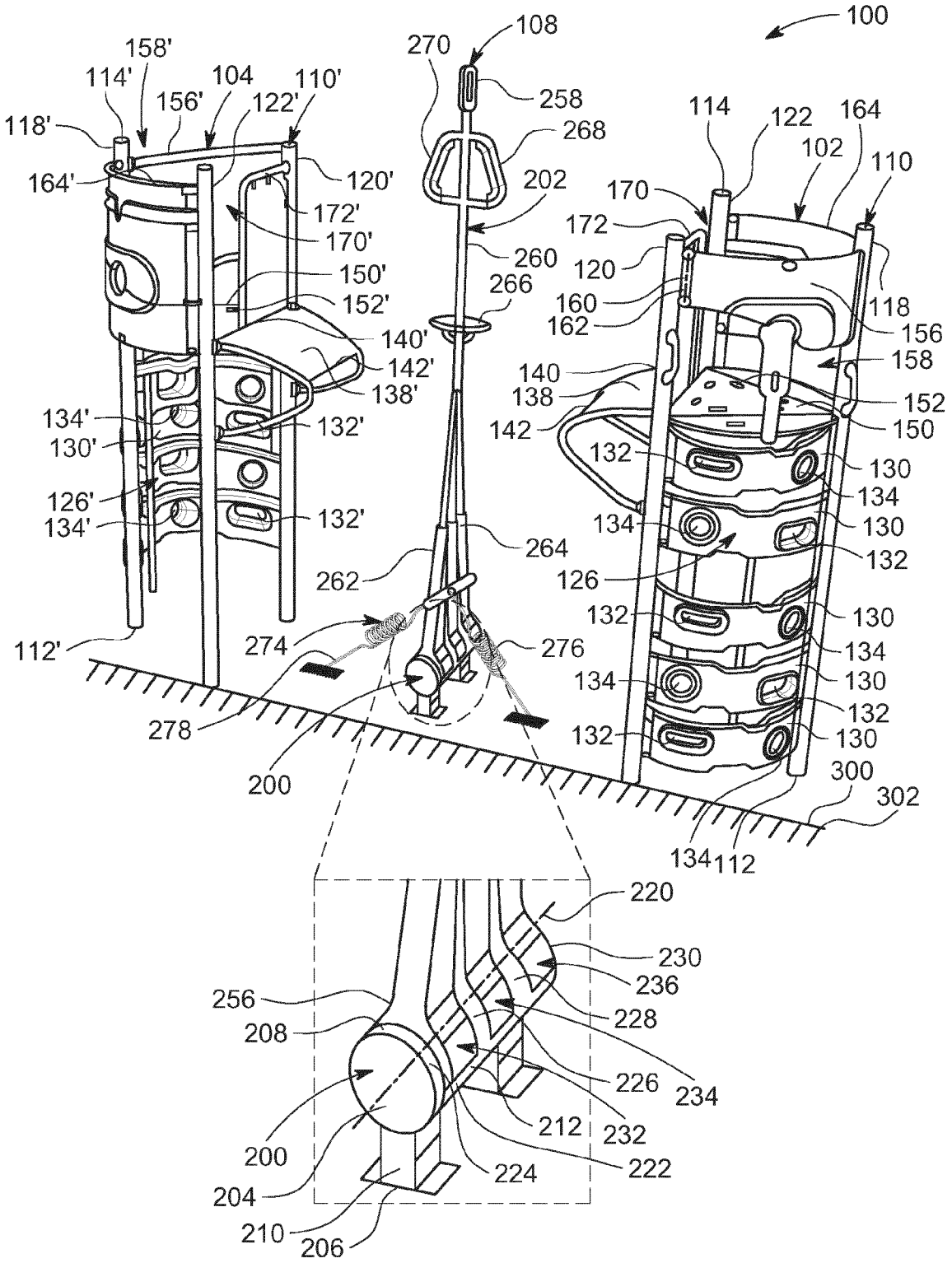
FIG. 1 shows a schematic perspective view of one potential embodiment of a playground apparatus according to an embodiment of the current invention.

Referring to FIG. 1, an exemplary playground apparatus 100 is shown. The playground apparatus 100 includes a first platform assembly 102, a second platform assembly 104 disposed spaced apart from the first platform assembly 102, and a pole structure 108 disposed between the first platform assembly 102 and the second platform assembly 104. As shown, the first platform assembly 102 is supported by a surface 300, such as a ground surface 302, and extends upwardly from the surface 300. The first platform assembly 102 includes an upright structure 110 adapted to extend substantially perpendicularly from the surface 300 and has a first end 112 in contact with the surface 300 and a second end 114 disposed away from the surface 300. In an embodiment, the upright structure 110 is a self-standing structure and may include a plurality of pillars, for example, a first pillar 118, a second pillar 120, and a third pillar 122, disposed spaced apart from each other and arrayed circularly for enabling a positioning of the upright structure 110 on the surface 300. The pillars 118, 120, 122 extends upwardly in a vertical direction from the surface 300. The upright structure 110 further includes a climbing structure 126 (also referred to as a first climbing structure 126) having a plurality of panels 130 disposed spaced apart from each other and arrayed linearly in a vertical direction from the first end 112 towards the second end 114. As shown, each panel 130 extends between the two pillars, for example, the first pillar 118 and the second pillar 120, and may be coupled/attached to the pillars 118, 120. Further, in an embodiment, each panel 130 may include at least one opening, for example, a first opening 132 and a second opening 134 horizontally spaced from the first opening 134, for providing hand and/or foot holes to facilitate a climbing up and down of a child. In an embodiment, the first opening 132 may include an oval shape, while the second opening 134 may include a circular shape. In an embodiment, a shape of the first opening 132 may be the same as the shape of the second opening 134. Although, the first climbing structure 126 having the plurality of panels 130 is contemplated, it may be appreciated that the first climbing structure 126 may include a single panel. In such a case, the panel may include a plurality of openings and/or protrusions, for example climbing grips, arrayed along a height of the panel and disposed spaced from each other. The plurality of openings/protrusions may define the plurality of steps of the first climbing structure. Other climbing options could also be imagined, for example a climbing rope, a ladder with ordinary rungs, a fireman's pole, etc.

The first platform assembly 102 further includes a first platform structure 138 disposed at a vertical distance (i.e. vertically spaced) from the surface 300, and is coupled to the two pillars, for example, the second pillar 120 and the third pillar 122. As shown, the first platform structure 138 extends outwardly from the pillars 120, 122 in a direction away from the upright structure 110 and towards the pole structure 108. In an embodiment, the first platform structure 138 is substantially parallel to the surface 300. In certain embodiments, the platform structure 138 may be disposed at an inclination relative to the surface 300 and the pillars 120, 122. As shown, the first platform structure 138 includes a first end 140 coupled/attached/engaged with the pillars 120, 122 (i.e. the upright structure 110), and a second end 142 disposed downwardly from the first end 140 and located distally from the upright structure 110. Accordingly, an upper surface of the first platform structure 138 defines an acute angle 'A of inclination relative to the pillars 120, 122. In an embodiment, the angle CA' may be in a range between twenty five degrees to forty five degrees. In an implementation, the angle 'A' may be thirty degrees. An inclination of the first platform structure 138 relative to the surface 300 or the upright structure 110 (i.e. the pillars 120, 122) may discourage children from sitting on the first platform structure 138 and using it as a more permanent resting place.

The first platform assembly 102 further includes a support platform 150 disposed substantially parallel to the surface 300 and located between the pillars 118, 120, 122 and connected to the pillars 118, 120, 122. Further, the support platform 150 is positioned between the second end 114 of the upright structure 110 and the first climbing structure 126 such that the support platform 150 and the first end 140 of the first platform structure 138 may be disposed at substantially the same height from the surface 300. In this manner, children can safely and easily move between the support platform 150 and the first platform structure 138. Further, the support platform 150 may include a plurality of holes 152 to facilitate a passage of snow or dirt therethrough, thereby preventing an accumulation of snow or dirt on the support platform 150.

Additionally, or optionally, the first platform assembly 102 may include a gate 156 for allowing and/or preventing an access of the support platform 150 from the first climbing structure 126 or vice versa via an access opening 158 defined between the first pillar 118, the second pillar 120, and the support platform 150. The gate 156 may include a first end pivotably coupled to the second pillar 120 and adapted to pivot about an axis 160 substantially parallel to the second pillar 120 for opening and closing the access opening 158. In an embodiment, the gate 156 may be attached to the second pillar 120 via a hinge assembly 162. In one embodiment, the plate 156 shown in the figures is fixed in position and cannot pivot out. As such, children can enter the upper portion of the first platform assembly via the opening 158.

Further, in a certain implementation, the first platform assembly 102 may include a first rail 164 disposed above the support platform 150 and extending from the first pillar 118 to the third pillar 122. Also, the first platform assembly 102 may include an access window 170 defined between the second pillar 120 and the third pillar 122 to facilitate a movement of the children between the first platform structure 138 and the support platform 150. In an embodiment, a second rail 172 may be disposed between the second pillar 120 and the third pillar 122 covering, partly, the access window 170. As shown, the second rail 172 may be disposed above the support platform 150 and may extend from the second pillar 120 towards the third pillar 122. The second rail 172 provides a support to the children during transitioning from the first platform structure 138 to the pole structure 108.

Again referring to FIGS. 1 to 3, the second platform assembly 104 is now explained. The second platform assembly 104 is disposed horizontally spaced from the first platform assembly 102 and extends upwardly from the surface 300. The second platform assembly 104 is similar in structure, construction, assembly, and function to that of the first platform assembly 102. Further, structure, construction, attachment and functions of various components, sub-assemblies, structures of the second platform assembly 104 are same as the structure, attachment, construction, and functions of the corresponding components, sub-assemblies, structures, etc., of the first platform assembly 102 unless otherwise specified. As shown, the second platform assembly 104 includes an upright structure 110' having a first end 112', a second end 114', a plurality of pillars, for example, a first pillar 118', a second pillar 120', and a third pillar 122', a climbing structure 126' (also referred to as a second climbing structure 126'), a plurality of panels 130', each panel having a pair of openings 132', 134'. The second platform assembly 104 further includes a platform structure 138' (also referred to as a second platform structure 138') having a first end 140' and a second end 142', a support platform 150' having a plurality of holes 152', an access opening 158', a gate 156', an axis, a hinge assembly, a first rail 164', a second rail 172', and an access window 170' facilitate a movement of the children between the second platform structure 138' and the pole structure 108.

Figure 2:
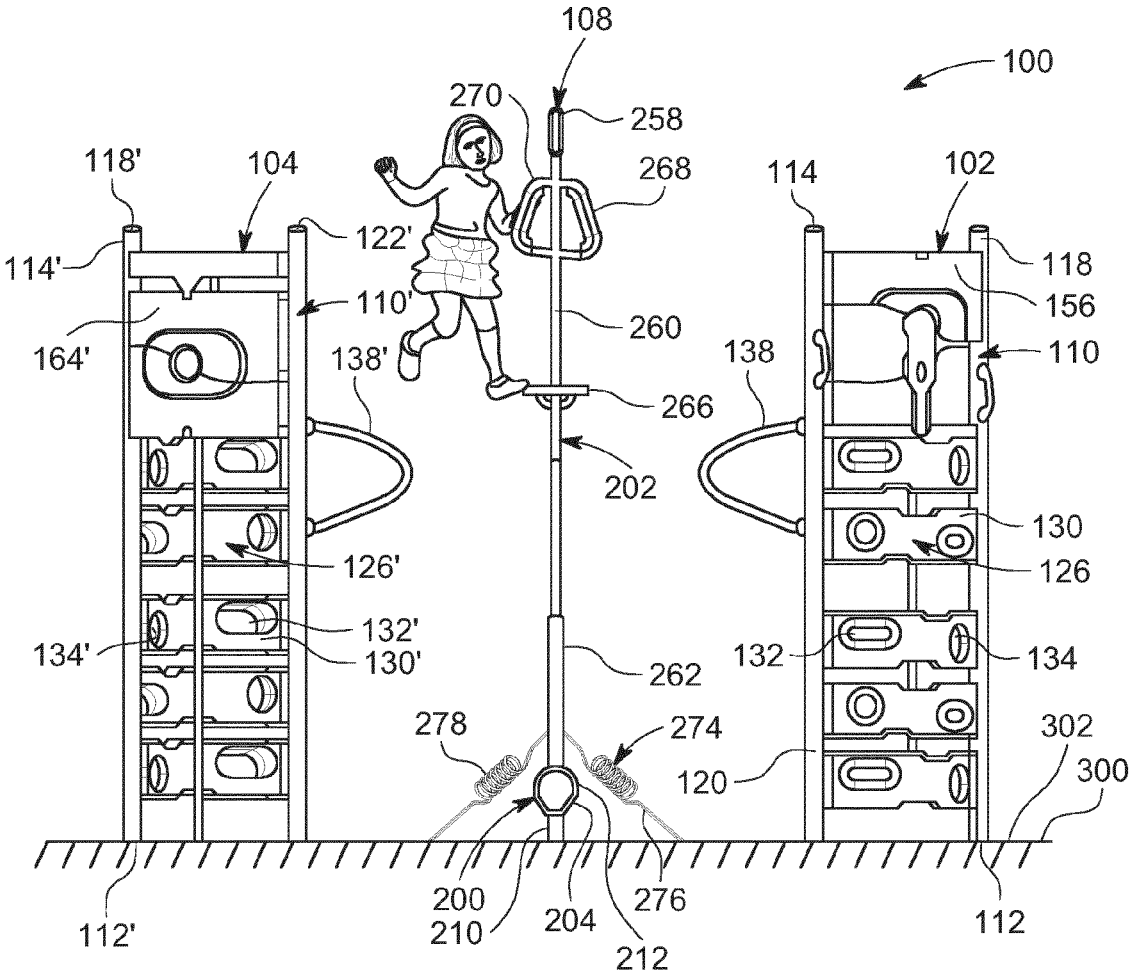
FIG. 2 shows a schematic side view of the playground apparatus according to an embodiment of the current invention.
Figure 3:
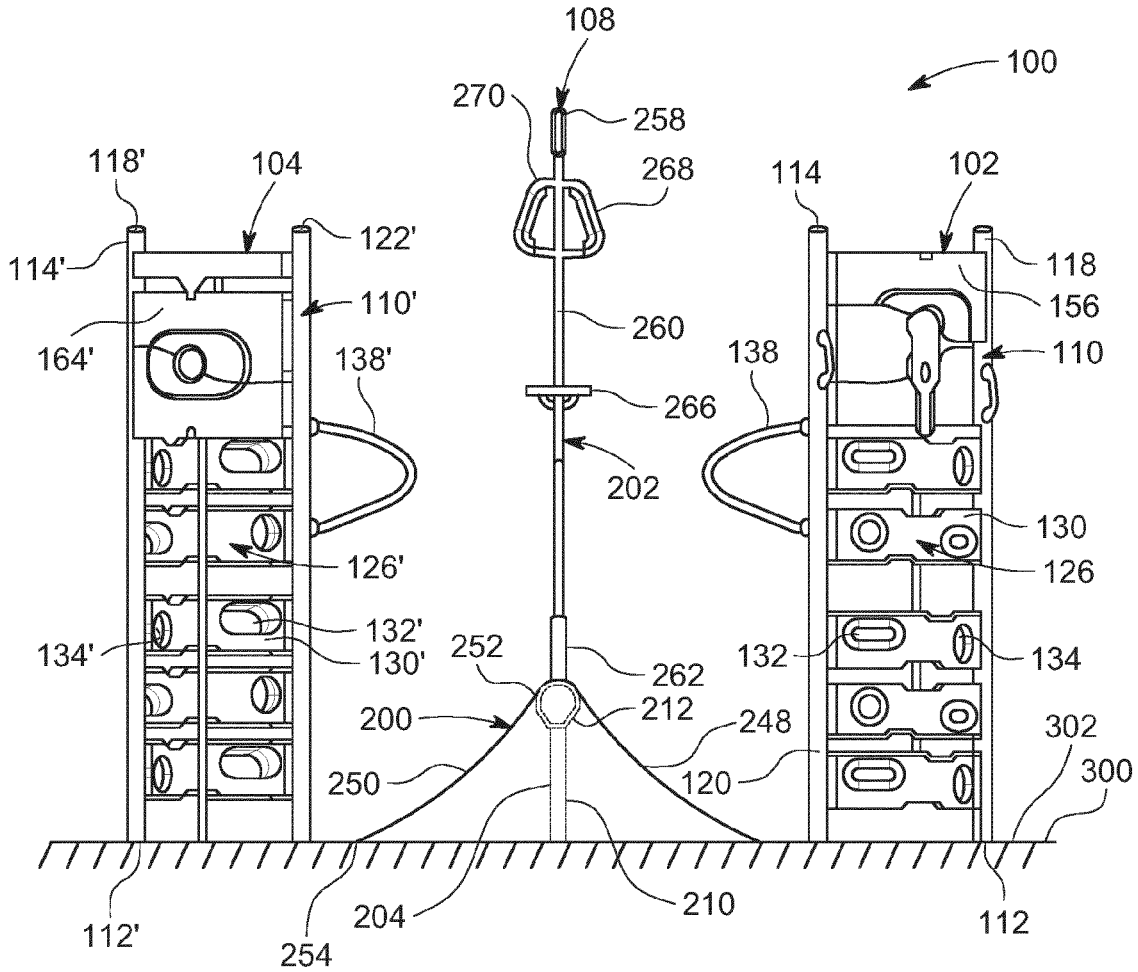
FIG. 3 shows a schematic side view of the playground apparatus including at least one safety structure according to an embodiment of the current invention

Further, as shown in FIGS. 1 to 3, the pole structure 108 extends upwardly from the surface 300 and includes a base portion 200 attached/coupled to surface 300, and a lever portion 202 pivotally engaged/attached to the base portion 202 and extending upwardly from the base portion 200. As shown, the base portion 200 includes an upright structure 204 extending upwardly from the surface 300 and having a first end 206 attached to the surface 300 and a second end 208 coupled to the lever portion 202. The upright structure 204 may include an elongated portion 210 extending substantially vertically upwardly from the surface 300, and an engagement portion 212 extending from the elongated portion 210 to the second end 208 of the upright structure 204. As shown, the engagement portion 212 may be adapted to partially receive the lever portion 202, and may be pivotally coupled with the lever portion 202. In an embodiment, the lever portion 202 is adapted to pivot about a pivot axis 220 that is substantially parallel to the surface 300. In an embodiment, the lever portion 202 is adapted or arranged to pivot between a first position and a second position.

Further, the engagement portion 212 may include at least two members extending upwardly from a base member 222 and disposed spaced apart from each other to define at least one cavity to receive the lever portion 202.

In an exemplary embodiment, the engagement portion 212 may include four members, for example, a first member 224, a second member 226, a third member 228, and a fourth member 230 defining three cavities, for example, a first cavity 232, a second cavity 234, and a third cavity 236, therebetween to receive the lever portion 202. The members 224, 226, 228, 230 are arranged in such a manner that the members 224, 226, 228, 230 facilitate the pivoting of the lever portion 202 about the pivot axis 220, while substantially restricting the pivoting of the lever portion 202 about an axis that is parallel to the surface 300 and at an angle to the pivot axis 220.

Additionally, or optionally, the pole structure, for example, the base portion 200 (as shown in FIG. 3) may include at least one safety structure 250 to facilitate a safe landing of the children to the surface 300 in the case that a child falls off the pole structure. In an embodiment, the safety structure 250 may extend circularly around the elongated portion 210. In such a case, the safety structure 250 may completely surround the elongated portion 210. The safety structure 250 includes a first end 252 connected to the upright structure 204 and a second end 254 disposed proximate or abutting the surface 300. The safety structure 250 is arranged in such a manner that a surface 248 of the safety structure 250 extends downwardly towards the surface 300 at an inclination relative to the upright structure 204, thereby facilitating a sliding of the children, should they fall from the structure, to the surface 300. In an embodiment, an angle of inclination between the safety structure 250 and the upright structure 204 (i.e. the elongated portion 210) may be an acute angle. Although a single safety structure is contemplated, it may be appreciated that the base portion 200 may include more than one safety structure. In such a case, the safety structures may be circularly arrayed around the elongated portion 210.

Again referring to FIGS. 1 to 3, the lever portion 202 may include first end 256, a second end 258, and a pole 260 extending from the first end 256 to the second end 258. The lever portion is adapted to pivot between a first position and a second position about an axis 220 which is parallel to the surface 300. An end of the pole 260 is pivotally coupled to the engagement portion 212 (i.e. the base portion 200), while another end of the pole 260 is a free end. Further, as shown in FIG. 1, the lever portion 202 may include two side levers, for example, a first side lever 262 and a second side lever 264, respectively disposed on each side of the pole 260 such that an end of the first side lever 262 and an end of second side lever 264 are connected to the pole 260, while respective other ends of the side levers 262, 264 are received within the first cavity 232 and the third cavity 236. Therefore, the side levers 262, 264 extend from the engagement portion 212 to the pole 260. In this manner, the side levers 262, 264 provide additional rigidity and support to the lever portion 202.

Further, the lever portion 202 includes at least one support structure 266 for supporting one or more children. As shown, the support structure 266 is a plate disposed circularly around the pole 260 and extending radially outwardly from the pole 260 and may be disposed proximate to the second end 258 of the lever portion 202. In an embodiment, a height of the support structure 266 from the surface 300 when in the first or second position may be substantially equal to a height of the first platform structure 138 and/or a height of the second platform structure 138' from the surface 300 to facilitate an easy movement of the children between the support structure 266 and the platform assemblies 102, 104. In an embodiment, the support structure 266 may include a plurality of holes (not shown) to prevent an accumulation of snow or dirt on a surface of the support structure 266. Although a single support structure is contemplated, it may be appreciated that the lever portion 202 may include a plurality of support structures, for example, two support structures disposed spaced apart and arrayed circularly around the pole 260. Additionally, the lever portion 202 may include at least one handle, for example a first handle 268 and a second handle 270, extending outwardly from the pole 260 and disposed between the support structure 266 and the second end 258. The handles 268, 270 are adapted to be held by the children when the children are standing on the support structure 266.

Further, as shown in FIG. 1 and FIG. 2, the playground apparatus 100 may include a spring assembly 274 for biasing the lever portion 202 to a central position between the first and second positions. In the central position, the lever portion 202 is disposed substantially perpendicularly to the surface. While in the first position, the lever portion 202 is positioned at an inclination to the surface 300 such that the support structure 266 is disposed proximate to the first platform structure 138. Further, in the second position, the lever portion 202 is positioned/arranged at an inclination to the surface 300 such that the support structure 266 is disposed proximate to the second platform structure 138'. The spring assembly 274 may include a first spring 276 extending from the lever portion 202 towards the first platform assembly 102 and connected to the surface 300 or to the first platform assembly 102, and a second spring 278 extending from the lever portion 202 towards the second platform assembly 104 and connected to the surface 300 or to the second platform assembly 104. As shown schematically, in an embodiment, an end of the first spring 276 is connected to the lever portion 202 and another end of the first spring 276 is connected to the surface 300. Similarly, as shown, an end of the second spring 278 is connected to the lever portion 202, while another end of the second spring 278 is connected to the surface 300. The first spring 276 and the second spring 278 together apply a force on the lever portion 202 (i.e. the pole 260) to return the lever portion 202 (i.e. the pole 260) towards the central position as the lever portion 202 pivots/moves away from the central position either towards the first position or towards the second position. In certain embodiments, one of the first spring 276 and the second spring 278 may be omitted, and in such a case, the spring assembly 274 may include a single spring.

Figure 6:
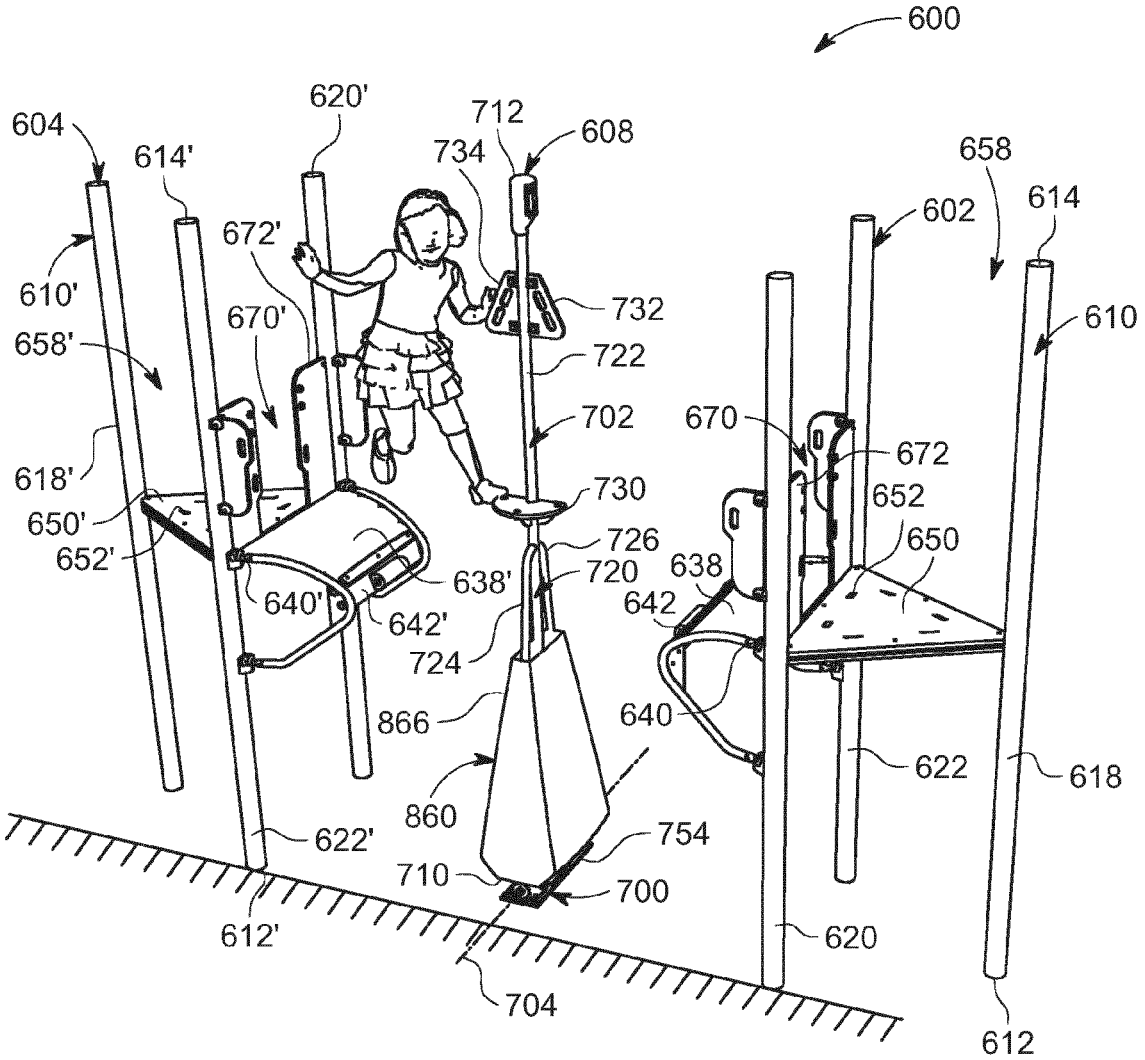
FIG. 6 shows a schematic side view of a playground apparatus having a spring assembly and a safety structure according to yet another embodiment of the current invention.
Figure 7:
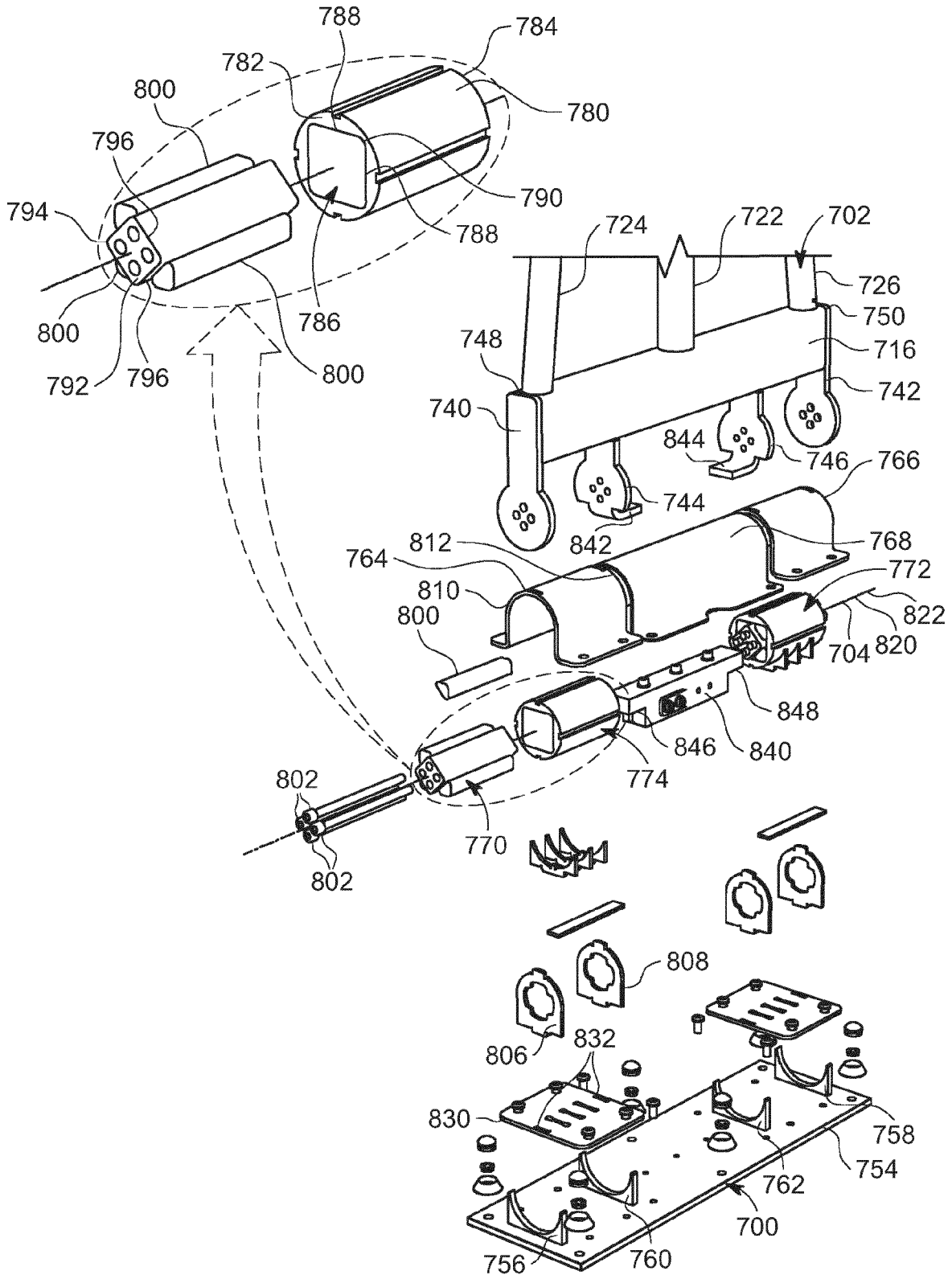
FIG. 7 shows a detailed exploded view of the spring assembly of FIG. 6 disposed into a base portion of a pole structure of the playground apparatus of FIG. 6 according to an embodiment of the current invention.

In a real world application, a spring assembly which is more hidden is important to ensure that children playing do not get injured from contact with the spring assembly. FIGS. 6 and 7 shows a more detailed embodiment of a combined spring and damper assembly.

Figure 4:
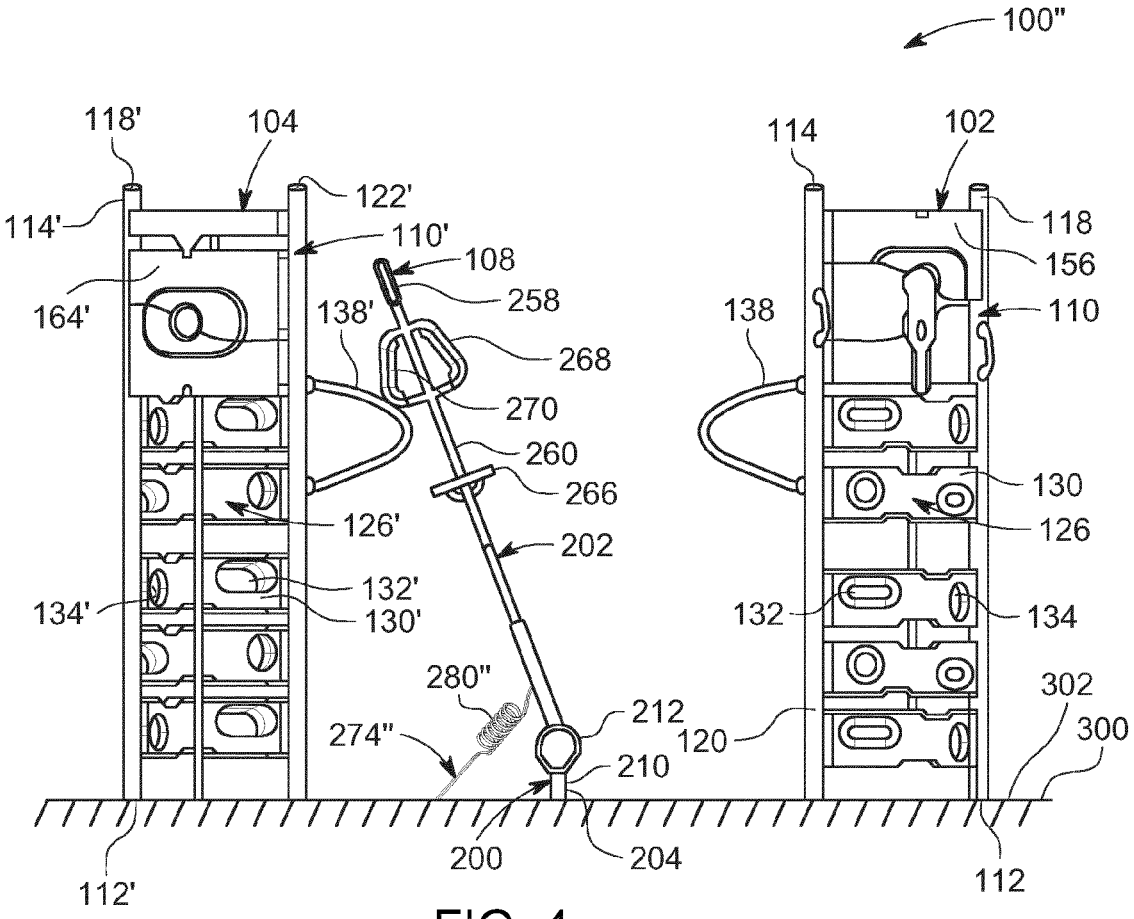
FIG. 4 shows a schematic side view of a playground apparatus having a spring assembly according to another embodiment of the current invention.

Referring to FIG. 4, a playground apparatus 100" is shown according to an alternative embodiment of the disclosure. A structure and construction of the playground apparatus 100" is similar to a structure and construction of the playground apparatus 100 apart from a structure, construction, and an attachment of the spring assembly. Further, the elements of the playground apparatus 100" having similar constructional and structural aspects as that of the elements of the playground apparatus 100 will have same reference numerals.

As shown in FIG. 4, the playground apparatus 100" may include a spring assembly 274" for biasing the lever portion 202 to the second position. As shown, in the second position, the lever portion 202 may abut the second platform structure 138'. The spring assembly 274" may include a biasing member 280", such as a tension spring, extending from the lever portion 202 towards the second platform assembly 104 and connected to the surface 300 or the second platform assembly 104. As shown, an end of the biasing member 280" is connected to the lever portion 202 and another end of the biasing member 280" is connected to the surface 300. The biasing member 280" is arranged such that the biasing member 280" applies a force on the lever portion 202 (i.e. the pole 260) to return the lever portion 202 (i.e. the pole 260) towards the second position as the lever portion 202 pivots away from the second position towards the first position. In an embodiment, the playground apparatus 100" may include a rope (not shown) attached to the pole 260 to facilitate a pulling of the pole 260 (i.e. the lever portion 202) to the first position from the second position by the one or more children standing on the first platform structure 138.

Figure 5:
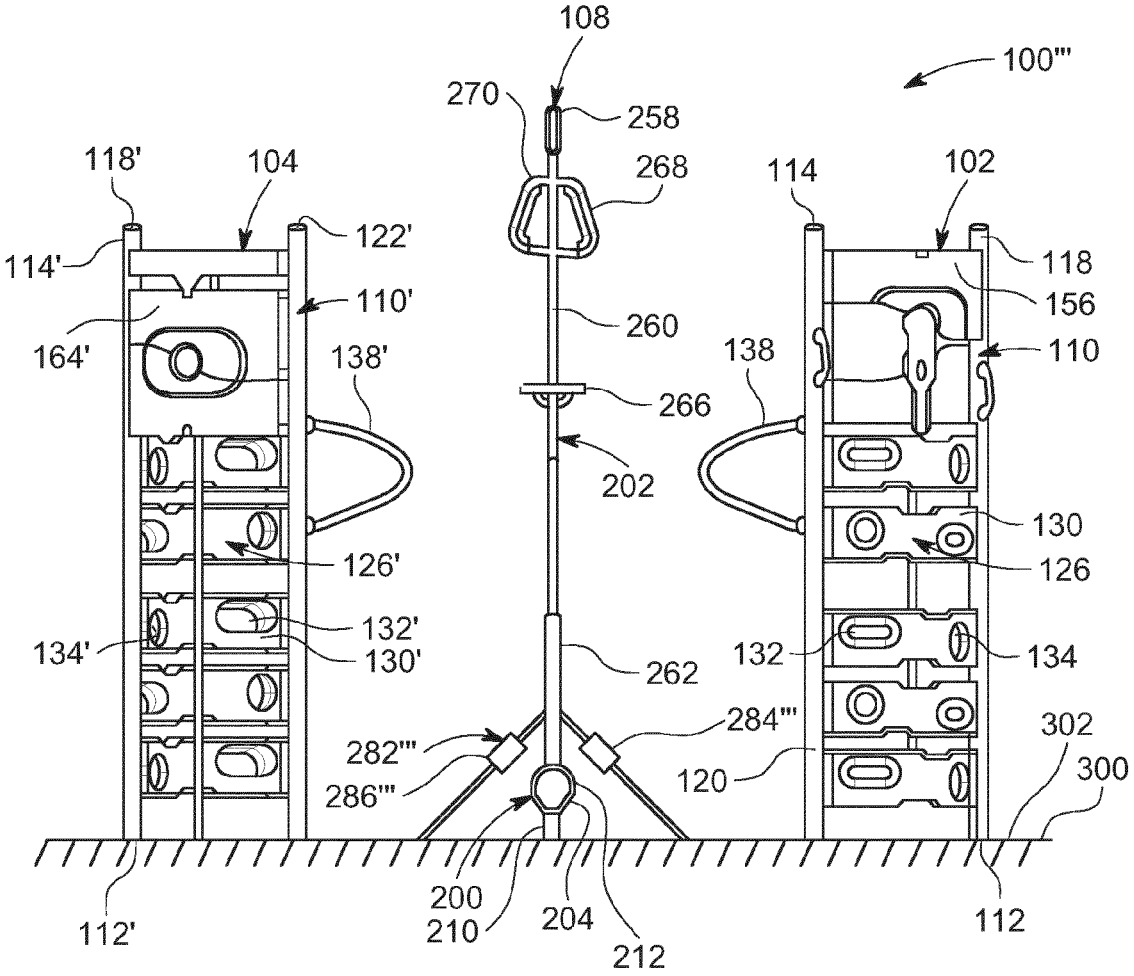
FIG. 5 shows a schematic side view of a playground apparatus having a damping assembly according to yet another embodiment of the current invention.

Referring to FIG. 5, a playground apparatus 100''' is shown according to another embodiment of the disclosure. The playground apparatus 100''' may be similar in structure and construction to the structure and construction of the playground apparatus 100. The difference between the playground apparatus 100''' and the playground apparatus 100 is that the spring assembly 274 is omitted from the playground apparatus 100 and the playground apparatus 100''' includes a damping assembly 282''' for damping a movement of the lever portion 202. Further, the elements of the playground apparatus 100''' having similar constructional and structural aspects as that of the elements of the playground apparatus 100 will have same reference numerals.

As shown in FIG. 5, the damping assembly 282''' may include a first damping member 284''' extending from the lever portion 202 towards the first platform assembly 102 and connected to the surface 300 or to the first platform assembly 102, and a second damping member 286''' extending from the lever portion 202 towards the second platform assembly 104 and connected to the surface 300 or to the second platform assembly 104. As shown, an end of the first damping member 284''' is connected to the lever portion 202 and another end of the first damping member 284''' is connected to the surface 300. Similarly, an end of the second damping member 286''' is connected to the lever portion 202, while another end of the second damping member 286" is connected to the surface 300. The first damping member 284''' and the second damping member 286''' together act to damp the movement of the lever portion 202. In certain implementation, one of the first damping member 284''' and the second damping member 286''' may be omitted, and in such a case, the damping assembly 282''' may include a single damping member. Further, it may be appreciated that the playground apparatus 100''' may include the spring assembly 274 of the playground apparatus 100 or the spring assembly 274" of the playground apparatus 100" in addition to the damping assembly 282'''. In this case, both a spring and a damping effect will be obtained.

In the above described embodiments, both platform assemblies were shown with climbing structures which allow a child to climb from the ground to the platform structure. However, in another embodiment, either the first or the second platform assemblies could be arranged without a real climbing structure. For example, in one embodiment (not shown), the first platform assembly comprises a climbing structure as shown, while the second platform assembly comprises a slide. In this case, the children are forced to climb up the first platform assembly, cross over to the second platform assembly via the pole and the slide down the slide. In this case, there is a more one way type of motion than in the previously described embodiments.

Referring to FIG. 6, a playground apparatus 600 is shown according to an alternative embodiment of the disclosure. The playground apparatus 600 includes a first platform assembly 602, a second platform assembly 604 disposed spaced horizontally apart from the first platform assembly 602, and a pole structure 608 disposed between the first platform assembly 602 and the second platform assembly 604. The first platform assembly 602 of the embodiment shown in FIG. 6 is similar in construction to the first platform assembly 102 of the embodiment shown in FIGS. 1-5 except that some of the elements or components of the first platform assembly 102 may be omitted from the first platform assembly 602. For example, the climbing structure 126 (also referred to as a second climbing structure 126), the plurality of panels 130, each panel having the pair of openings 132, 134, the gate 156, the hinge assembly, the first rail 164 may be omitted in the first platform assembly 602. Further, as shown, the first platform assembly 602 may include an upright structure 610 having a first end 612, a second end 614, a plurality of pillars, for example, a first pillar 618, a second pillar 620, and a third pillar 622. The first platform assembly 602 further includes a platform structure 638 (also referred to as a first platform structure 638) having a first end 640 and a second end 642, a support platform 650 having a plurality of holes 652, an access opening 658, a second rail 672, and an access window 670 facilitate a movement of the children between the first platform structure 638 and the pole structure 608.

Further, the second platform assembly 604 is disposed horizontally spaced from the first platform assembly 602 and extends upwardly from the surface 300. The second platform assembly 604 is similar in structure, construction, assembly, and function to that of the first platform assembly 602. Further, structure, construction, attachment and functions of various components, sub-assemblies, structures of the second platform assembly 604 are the same as the structure, attachment, construction, and functions of the corresponding components, sub-assemblies, structures, etc., of the first platform assembly 602 unless otherwise specified. As shown, the second platform assembly 604 may include an upright structure 610' having a first end 612', a second end 614', a plurality of pillars, for example, a first pillar 618', a second pillar 620', and a third pillar 622'. The second platform assembly 604 further includes a platform structure 638' (also referred to as a second platform structure 638') having a first end 640' and a second end 642', a support platform 650' having a plurality of holes 652', an access opening 658', a second rail 672', and an access window 670' to facilitate a movement of the children between the second platform structure 638' and the pole structure 608'.

Further, the pole structure 608 extends upwardly from the surface 300 and includes a base portion 700 attached/coupled to surface 300, and a lever portion 702 pivotally engaged/attached to the base portion 700 and extending upwardly from the base portion 700. In an embodiment, the lever portion 702 is adapted to pivot about a pivot axis 704 that is substantially parallel to the surface 300. In an embodiment, the lever portion 702 is adapted or arranged to pivot between a first position and a second position.

Referring to FIG. 6 and FIG. 7, the lever portion 702 may include first end 710, a second end 712, a base 716 disposed at the first end 710 and extending substantially horizontally and parallel to the surface 300, and an upright structure 720 extending substantially perpendicularly and upwardly from the base 716. The upright structure 720 may include a pole 722 extending from the base 716 and two side levers, for example, a first side lever 724 and a second side lever 726, respectively disposed on each side of the pole 722 such that an end of the first side lever 724 and an end of the second side lever 726 are connected to the pole 722, while respective other ends of the side levers 724, 726 are attached to the base 716. Therefore, the side levers 724, 726 extend from the base 716 to the pole 722. In this manner, the side levers 724, 726 provide additional rigidity and support to the lever portion 702.

Further, the lever portion 702 includes at least one support structure 730 for supporting one or more children. As shown, the support structure 730 is a plate disposed circularly around the pole 722 and extending radially outwardly from the pole 722 and may be disposed proximate to the second end 712 of the lever portion 702. In an embodiment, a height of the support structure 730 from the surface 300 when in the first or second position may be substantially equal to a height of the first platform structure 638 and/or a height of the second platform structure 638' from the surface 300 to facilitate an easy movement of the children between the support structure 730 and the platform assemblies 602, 604. In an embodiment, the support structure 730 may include a plurality of holes (not shown) to prevent an accumulation of snow or dirt on a surface of the support structure 730. Although a single support structure is contemplated, it may be appreciated that the lever portion 702 may include a plurality of support structures, for example, two support structures disposed spaced apart and arrayed circularly around the pole 722. Additionally, the lever portion 702 may include at least one handle, for example a first handle 732 and a second handle 734 extending outwardly from the pole 722 and disposed between the support structure 730 and the second end 712. The handles 732, 734 are adapted to be held by the children when the children are standing on the support structure 730.

Referring to FIG. 7, the lever portion 702 may include a plurality of extension members extending downwardly from a base 716 and being linearly arrayed along the base 716. The plurality of extension members, for example, a first extension member 740 a second extension member 742, a third extension member 744, and a fourth extension member 746, are disposed horizontally spaced apart from each other. Further, as illustrated, the first extension member 740 is attached to a first lateral end 748 of the base 716, while the second extension member 742 is attached to a second lateral end 750 of the base 716. Further, the third extension member 744 is disposed proximate to the first extension member 740 and is located between the first extension member 740 and the fourth extension member 746, while the fourth extension member 746 is disposed proximate to the second extension member 742 and is located between the second extension member 742 and the third extension member 744.

The extension members 740, 742, 744, 746 may be engaged with the base portion 700 to facilitate a pivotal motion of the lever portion 702 relative to the base portion 700. The base portion 700 may include a base plate 754 adapted to attached with the surface 300, a plurality of brackets, for example a first bracket 756, a second bracket 758, a third bracket 760, and a fourth bracket 762, extending upwardly from the base plate 754 and adapted to receive and support the plurality of extension members 740, 742, 744, 746. In one embodiment, the first bracket 756, the second bracket 758, the third bracket 760, and the fourth bracket 762 are, respectively, engaged with the first extension member 740, the second extension member 742, the third extension member 744, and the fourth extension member 746. Further, the base portion 700 may include a plurality of housings, for example, a first housing 764, a second housing 766, and a third housing 768, attached to the base plate 754. Each of the housings 764, 766, 768 may be a hollow semi-cylindrical structure and may be attached to the base plate 754 using fasteners. In an embodiment, the first housing 764 is disposed between the first bracket 756 and the third bracket 760, the second housing 766 is disposed between the second bracket 758 and the fourth bracket 762, and the third housing 768 is disposed between the third bracket 760 and the fourth bracket 762. In an embodiment, the first housing 764 is adapted to house a first torsional spring and damper assembly 774, while the second housing 766 is adapted to house a second torsional spring and damper assembly 772.

The spring assemblies 772, 774 are in this embodiment arranged to bias the lever portion 702 to a central position. In the central position, the lever portion 702 is disposed substantially perpendicularly to the surface 300, while in the first position, the lever portion 702 is positioned at an inclination to the surface 300 such that the support structure 730 is disposed proximate to the first platform structure 638. Further, in the second position, the lever portion 702 is positioned/arranged at an inclination to the surface 300 such that the support structure 730 is disposed proximate to the second platform structure 638'. The spring assemblies 772, 774 together apply a force on the lever portion 702 (i.e. the pole) to return the lever portion 702 (i.e. the pole) towards the central position when the lever portion 702 pivots/moves away from the central position either towards the first position or towards the second position. In an embodiment, the first spring 774 and the second spring 772 are torsional springs. A structure, an assembly, a function, and an attachment of the first spring 770 with the base portion 700 and the lever portion 702 is now explained. It may be appreciated that a structure, an assembly, a function, and an attachment of the second spring 772 with the base portion 700 and the lever portion 702 is similar to the structure, the assembly, the function, and the attachment of the first spring 774 with the base portion 700 and the lever portion 702, and therefore, for the sake of clarity and brevity, only the first spring 774 and its assembly with the base portion 700 and the lever portion 702 is explained.

The first spring assembly 774 includes an elongated member 780 having a first end 782, a second end 784, and an elongated cavity 786 extending from the first end 782 to the second end 784. In an embodiment, the elongated cavity 786 includes a square cross-section, and has a four sides 788 and four corners 790. The first spring 774 also include an elongated shaft 792 having a square cross-section and adapted to be inserted, at least partially, inside the elongated cavity 786. The elongated shaft 792 may be disposed inside the elongated cavity 786 such that corners 794 of the elongated shaft 792 contact or abut the sides 788 of the elongated cavity 786, while sides 796 of the elongated shaft 792 are disposed facing the corners 790 of the elongated cavity 786, thereby defining gaps, for example, four gaps, therebetween.

In an embodiment, the first spring 770 may include a plurality of flexible members 800, for example, four flexible members 800, adapted to be disposed inside the gaps such that a single flexible member 800 is inserted inside a single gap. Further, when disposed inside the gap, the flexible member 800 abuts an inner surface of the elongated member 780 and an outer surface of the elongated shaft 792. The flexible members 800 are adapted to deform when the elongated shaft 792 rotates inside the elongated cavity 786. Due to the deformation of the flexible members 800, the flexible members 800 apply a torque on the elongated shaft 792 to rotate the elongated shaft 792 to an original position. In an embodiment, the elongated shaft 792 is coupled/engaged with the first extension member 740 and the third extension member 744 via a plurality of fasteners 802. Accordingly, when the lever portion 702 moves away from the central position, the first spring 774 (i.e. the flexible members 800) applies a biasing force on the lever portion 702 to move back the lever portion 702 towards the central position. In certain implementations the flexible members 800 may be made of rubber. Therefore, the flexible members 800 also dampen the motion of the elongated shaft 792, and hence the first spring 774 damps the motion of the lever portion 702.

Further, the first spring 774 may include a pair of support brackets, for example a first support bracket 806 disposed at a first end 810 of the first housing 764 and a second support bracket 808 disposed at a second end 812 of the first housing 764, for receiving and supporting the elongated shaft 792 such that the a central axis 820 of the elongated shaft 792 is disposed coaxially to a central axis 822 of the elongated cavity 786. Further, the lever portion 702 pivots relative to the base portion 700 about the pivot axis 704 that is coaxial to the central axis 822. The first support bracket 806 abuts the first end 810, while the second support bracket 808 abuts the second end 812. Further, the support brackets 806, 808 are supported by the base plate 754. In an embodiment, the support brackets 806, 808 are engaged with a plate 830 that in turn is attached to the base plate 754. In such a case, the plate 830 may include a pair of cavities 832 in which the support brackets 806, 808 may be press-fitted. In certain embodiments, one of the first spring 774 and/or the second spring 772 may be omitted, and in such a case, the spring assembly 770 may include a single spring. Springs of this type are often called ROSTA type springs as they are made by the company called Rosta AG.

Additionally, or optionally, the base portion 700 may include an elongated stopper 840 disposed inside the third housing 768 and attached to the base plate 754. Further, the elongated stopper 840 is adapted to engage with the third extension member 744 and the fourth extension member 746. As shown, the third extension member 744 includes a plate 842 extending substantially horizontally and adapted to abut or engage with a first step 846 of the elongated stopper 840. Similarly, the fourth extension member 746 may include a plate 844 extending substantially horizontally and adapted to abut/engage with a second step 848 of the elongated stopper 840. An abutment of the plates 842, 844 with the steps 846, 848 prevents a movement of the lever portion 702 in an upward direction, thereby ensures a positive engagement or retention of the lever portion 702 with the base portion 700.

Additionally, or optionally, in an embodiment (as shown in FIG. 6), the pole structure 608, for example, the lever portion 702 may include at least one safety structure 860 to facilitate a safe landing of the children to the surface 300 in the case of an accidental fall. In an embodiment, the safety structure 860 may extend from the first end 710 towards the support structure 730, and may be disposed below the support structure 730. In an embodiment, the safety structure 860 may completely surround a portion of the lever portion 702. As shown, the safety structure 860 is connected to an upright structure 720, and is arranged in such a manner that a surface 866 of the safety structure 250 extends downwardly towards the surface 300 at an inclination relative to the upright structure 720, thereby facilitating a sliding of the children, should they fall from the structure, to the surface 300. In an embodiment, an angle of inclination between the safety structure 860 and the upright structure 720 may be an acute angle. As shown, the safety structure 860 may include a polygonal shape. Although a single safety structure is contemplated, it may be appreciated that the lever portion

702 may include more than one safety structure. In such a case, the safety structures may be circularly arrayed around the pole 722.

An operation of the playground apparatus 100 is now explained and it may be envisioned that the operation of the playground apparatus 100", 100'", 600 will be similar. For playing, a child may climb up to the support platform 150 by using the first climbing structure 126. Thereafter, the child moves to the first platform structure 138 through the access window 170 and pulls the pole 260, and hence the lever portion 202 towards himself, i.e. to the first position from the central position. In an embodiment, the child may pull the pole 260 towards the first platform structure 150 by grabbing and pulling the first handle 268 using one hand, while holding the second rail 172. In a certain implementation (not shown), a rope may be attached to the lever portion 202 and the child may utilize the rope to pull the lever portion 202 to the first position. Upon pulling the lever portion 202 to the first position, the child may step on the support structure 266 and subsequently release the second rail 172. Due to the biasing force provided by the spring assembly 274, the lever portion 202 (i.e. the pole 260) may move towards the central position. In a case where the spring biasing force is small, the child will have to push off with his or feet or hands to propel the lever portion away from the first platform.

Thereafter, the child may push the lever portion 202 towards the second position. Upon reaching the second position the child can move him or herself off of the lever portion and over to the second platform structure. In this manner, the child may experience a pole-vaulting effect. Further, in order to get off the pole structure 108 in a safe manner, the child may grab the second rail 172' of the second platform assembly 104 and accordingly move to the second platform structure 138' in a safe manner. Thereafter, the child may get down to the surface 300 by using the second climbing structure 126'. In this manner, the playground apparatus 100 provides easy climbing between the surface 300 and the platform structures 138, 138' and subsequently to the support structure 266.

In one embodiment, the pole structure is arranged to physically contact the first and second platform structures when in the first and second positions respectively. In this case, a bumper element could be arranged on the forward portion of the first and second platform structures. During use, the pole structure could move towards the platform structure and then contact the bumper structure to soften the impact. In one embodiment, instead of having a spring assembly which biases the structure to the centre, the apparatus could be provided with a spring and/or damping assembly which engages the pole structure when it approaches the first and or second position to slow down the motion towards the first and/or second platform.

It is to be noted that the figures and the above description have shown the example embodiments in a simple and schematic manner. Many of the specific mechanical details have not been shown since the person skilled in the art should be familiar with these details and they would just unnecessarily complicate this description.

LIST OF ELEMENTS

100 playground apparatus
100" playground apparatus
100'" playground apparatus
102 first platform assembly
104 second platform assembly
108 pole structure
110 upright structure
110' upright structure
112 first end
112' first end
114 second end
114' second end
118 first pillar
118' first pillar
120 second pillar
120' second pillar
122 third pillar
122' third pillar
126 first climbing structure
126' second climbing structure
130 panel
130' panel
132 first opening
132' first opening
134 second opening
134' second opening
138 first platform structure
138' second platform structure
140 first end
140' first end
142 second end
142' second end
150 support platform
150' support platform
152 holes
152' holes
156 gate
156' gate
158 access opening
158' access opening
160 axis
162 hinge assembly
164 first rail
164' first rail
170 access window
170' access window
172 second rail
172' Second rail
200 base portion
202 lever portion
204 upright structure
206 first end
208 second end
210 elongated portion
212 engagement portion
220 pivot axis
222 base member
224 first member
226 second member
228 third member
230 fourth member
232 first cavity
234 second cavity
236 third cavity
248 surface
250 side structure
252 first end
254 second end
256 first end
258 second end
260 pole
262 first side lever
264 second side lever

266 support structure
268 first handle
270 second handle
274 spring assembly
274" spring assembly
276 first spring
278 second spring
280" biasing member
282'" damping assembly
284'" first damping member
286'" second damping member
300 surface
302 ground surface
600 playground apparatus
602 first platform assembly
604 second platform assembly
608 pole structure
610 upright structure
610' upright structure
612 first end
612' first end
614 second end
614' second end
618 first pillar
618' first pillar
620 second pillar
620' second pillar
622 third pillar
622' third pillar
638 first platform structure
638' second platform structure
640 first end
640' first end
642 second end
642' second end
650 support platform
650' support platform
652 holes
652' holes
658 access opening
658' access opening
670 access window
670' access window
672 second rail
672' second rail
700 base portion
702 lever portion
704 pivot axis
710 first end
712 second end
716 base
720 upright structure
722 pole
724 first side lever
726 second side lever
730 support structure
732 first handle
734 second handle
740 first extension member
742 second extension member
744 third extension member
746 fourth extension member
748 first lateral end
750 second lateral end
754 base plate
756 first bracket
758 second bracket
760 third bracket
762 fourth bracket
764 first housing
766 second housing
768 third housing
770 first spring
772 second spring
774 spring assembly
780 elongated member
782 first end
784 second end
786 elongated cavity
788 sides
790 corners
792 elongated shaft
794 corners
796 sides
800 flexible member
802 fastener
806 first support bracket
808 second support bracket
810 first end
812 second end
820 central axis
822 central axis
830 plate
832 cavity
840 elongated stopper
842 plate
844 plate
846 first step
848 second step
860 safety structure
866 surface

The invention claimed is:

1. A playground apparatus, comprising:

a first platform assembly extending upwardly from a surface and including a first platform structure disposed at a vertical distance from the surface;

a second platform assembly extending upwardly from the surface and disposed spaced apart from the first platform assembly, the second platform assembly includes a second platform structure disposed at a vertical distance from the surface; and a pole structure extending upwardly from the surface and disposed between the first platform assembly and the second platform assembly, the pole structure including a lever portion having at least one support structure for supporting a child, the lever portion being adapted to be pivoted between a first position and a second position, wherein in the first position, the at least one support structure is disposed proximate to the first platform structure, in the second position, the at least one support structure is disposed proximate to the second platform structure, and a height of the at least one support structure from the surface when in the first or second position is configured to be substantially equal to a height of the first platform structure and/or a height of the second platform structure from the surface to facilitate an easy movement of a child between the support structure and the platform assemblies.

2. The playground apparatus of claim 1 further including a spring assembly for biasing the lever portion to a central position, wherein, in the central position, the lever portion is disposed substantially perpendicularly to the surface.

3. The playground apparatus of claim 2, wherein the spring assembly includes a first spring coupled between the lever portion and one of the first platform assembly or the surface, and/or a second spring coupled between the lever portion and one of the second platform assembly or the surface.

4. The playground apparatus of claim 2, wherein the spring assembly includes a first spring coupled to the lever portion, the first spring being a torsional spring, and/or a second spring coupled to the lever portion, the second spring being a torsional spring.

5. The playground apparatus of claim 1, wherein the pole structure includes a base portion attached to the surface and supporting the lever portion, wherein the lever portion is adapted to pivot relative to the base portion.

6. The playground apparatus of claim 5, wherein the base portion and/or the lever portion include an upright structure and at least one safety structure having a surface extending downwardly at an inclination relative to the upright structure.

7. The playground apparatus of claim 1, wherein the first platform assembly includes a first climbing structure to facilitate a climbing between the surface and the first platform structure, and/or the second platform assembly includes a second climbing structure to facilitate a climbing between the surface and the second platform structure.

8. The playground apparatus of claim 1, wherein each of the first platform structure and the second platform structure comprises an upper surface which is disposed at an inclination relative to the surface.

9. The playground apparatus of claim 1 further including a spring assembly for biasing the lever portion towards the second position.

* * * * *